US006877929B1

(12) United States Patent
Yang

(10) Patent No.: US 6,877,929 B1
(45) Date of Patent: Apr. 12, 2005

(54) SPEED HUMP DEVICE

(76) Inventor: Chih-Cheng Yang, 7F, No. 30, Shui-Tui 25th Lane, Tam-Shui, Taipei (TW)

( * ) Notice: Subject to any disclaimer, the term of this patent is extended or adjusted under 35 U.S.C. 154(b) by 0 days.

(21) Appl. No.: 10/944,739

(22) Filed: Sep. 21, 2004

(30) Foreign Application Priority Data

Sep. 24, 2003 (TW) ..... 92126276 A

(51) Int. Cl.[7] ..... E01F 11/00; E01F 9/06
(52) U.S. Cl. ..... 404/11; 404/10; 404/15
(58) Field of Search ..... 404/6, 9–16, 84.05; 49/49

(56) References Cited

U.S. PATENT DOCUMENTS

| | | | | | |
|---|---|---|---|---|---|
| 3,748,782 | A | * | 7/1973 | Reynolds | 49/49 |
| 4,490,068 | A | * | 12/1984 | Dickinson | 404/6 |
| 4,627,763 | A | * | 12/1986 | Roemer et al. | 404/6 |
| 4,850,737 | A | * | 7/1989 | Nasatka et al. | 404/6 |
| 4,861,185 | A | * | 8/1989 | Eikelenboon | 404/6 |
| 4,974,991 | A | * | 12/1990 | Mandavi | 404/6 |
| 5,486,065 | A | * | 1/1996 | James | 404/15 |
| 5,509,753 | A | * | 4/1996 | Thompson | 404/6 |
| 6,010,277 | A | * | 1/2000 | Follman | 404/11 |

* cited by examiner

*Primary Examiner*—Thomas B. Will
*Assistant Examiner*—Alexandra K. Pechhold
(74) *Attorney, Agent, or Firm*—Rosenberg, Klein & Lee

(57) ABSTRACT

A speed hump device for discouraging vehicles form exceeding a designed threshold speed is disclosed. The speed hump device mainly comprises: a housing device, whose figure is like a box, having a housing room therein and a opening thereon; a hump device with a hump member and a arc-shaped member pivoted on the housing device by a first pivot, the hump member can be rotated in and out the housing room from the opening about the first pivot; a transmission device including a gear set, a transmitting mechanism and a abutment member, wherein the arc-shaped member is engaged with one gear of the gear set; a rebound device used to push the hump member out the housing device when no extra force presses on the hump member. When a car passing through the speed hump device with a slow speed, e.g., below a threshold speed, the abutment member will be put down and the hump member can be depressed in the housing room by the wheels of the car, hence the hump member as a jolt will disappear and the car will traverse smoothly; on the contrary, if the speed of the car is over the threshold speed, the hump member will be still in the position out the housing room that a jolt will occur to cause a impact effect to the car. Additionally, the hump member of the speed hump device will have an impedimental effect to a car goes against the traffic flow direction. Moreover, it does not consume any additional energy to drive the speed hump device.

20 Claims, 16 Drawing Sheets

SPEED HUMP DEVICE

BACKGROUND OF THE INVENTION

1. Field of the Invention

The present invention relates to a speed hump device, and more particularly to a speed hump device for discouraging motor vehicles form exceeding a demanded threshold speed.

2. Description of the Prior Art

One such known traditional speed hump 100, as shown in FIG. 1, is a so-called "sleeping policeman" including one or more raised portions as humps extending across, usually fully across, the "controlled" road or traffic surface. By the sufficient height of the raised portions, the traditional speed hump 100 causes noticeable impact or jolt effect to cars or other motor vehicles. In general, although different traditional speed humps could be designed to any kind of figure and made of different materials, they have all motor vehicles run thereon suffered a uncomfortable impact effect weather the speed of the motor vehicles are fast or slow, and that is real a torment to a diver who obey the traffic rule and drive slowly, specially, slower than a demanded threshold speed, further, that also causes harm to the motor vehicles.

Additionally, drivers meeting the traditional speed hump 100 for the first time usually assume that it will provide a severe impact, so that those wishing to avoid such an impact effect need to slow down to a very low traverse speed, no matter what the actual height of the traditional speed hump 100 and the very low traverse speed may be much lower than necessary, namely, slowing down the car more than which is required. Therefore, the traditional speed hump 100 is not suitable for most traffic roads. Another traditional traffic hump 200 is shown as FIG. 2. The traditional traffic hump 200 will cause an impedimental effect to the motor vehicles whose going direction against the traffic flow direction to prevent them from passing through the traditional hump 200. However, the traditional traffic hump 200 could not be used to be a speed hump, as the traditional speed hump 100 shown in FIG. 1, since the sharp figure of the traditional traffic hump 200 will cause serious harm to a running car.

Due to the disadvantages of the traditional speed humps mentioned above, it needs to provide a speed hump device which can automatically determine weather let a motor vehicle get a smooth road surface or not according to its speed. For example, when the speed of a running car is over a demanded threshold speed, the hump member of the provided speed hump device would be in the position above the road surface and that causes an uncomfortable impact or jolt effect to the running car; and when the speed is below the demanded threshold speed, the hump member will be depressed into alignment with the road surface by the wheels of the running car and the uncomfortable impact or jolt effect will disappear, then the running car traverses the road smoothly. Besides, the provided speed hump device has an impedimental effect to the motor vehicles whose going direction against the traffic flow direction. Furthermore, it does not need to consume any additional energy to drive the provided speed hump device.

SUMMARY OF THE INVENTION

It is one of objectives of the present invention to provide a speed hump device which can improve the disadvantages of the traditional speed hump devices.

It is another one of objectives of the present invention to provide a speed hump device which can automatically determine weather let a motor vehicle get a smooth road surface or not according to the speed of the motor vehicle passing through thereon.

It is another one of objectives of the present invention to provide a speed hump device that can be pre-set a demanded threshold speed thereof and if a speed of a motor vehicle passing through thereon is over the demanded threshold speed, the speed hump device will cause an impact effect to the motor vehicle, otherwise, if the speed is below the demanded threshold speed, let the motor vehicle go through smoothly.

It is another one of objectives of the present invention to provide a speed hump device that has a impact effect to a motor vehicle whose speed is faster than a certain speed and an impedimental effect to a motor vehicle whose going direction against the traffic flow direction, and moreover it does not need to consume any additional energy to drive the speed hump device.

According to the above-mentioned objections, the present invention provides a speed hump device including a housing device; a hump device; a transmission device; and a rebound device, wherein the housing device having a housing room therein and an opening thereon; the hump device having a hump member pivoted on the housing device by a rotational pivot and a arc-shaped portion with a gear-teeth portion mounted on the hump member; the transmission device having a gear set, a transmitting mechanism and an abutment member and the rebound device used to push the hump member to stretch out the housing room. When a car with a slow speed passes through the speed bump device, the abutment member would be put down due to the speed is less than the pre-set demanded threshold speed in the speed hump device, and the hump member could be depressed within the housing device by the wheels of the motor vehicle; when the speed of the car is larger than the pre-set demanded threshold speed of the speed hump device, the abutment member would maintain the stand position perpendicularly to the hump member to let the hump member lay thereon, and the hump member maintain the position out of the housing device, such that the car cannot pass through the speed hump device smoothly, or makes the car get a bumpy road.

The above-mentioned contents of the present invention and the following description of the preferred embodiments are only for example, not intended to limit the scope of the invention. Thus, many equal variations and modifications of the following embodiments could be made without departing form the spirit of the present invention should be covered by the following claims.

BRIEF DESCRIPTION OF THE DRAWINGS

The objectives, features of the present invention as well as the advantages thereof can be best understood through the following preferred embodiments and the accompanying drawings, wherein.

DESCRIPTION OF THE PREFERRED EMBODIMENT

The invention will be explained in detail in accordance with the accompanying drawings. It is necessary to illustrate that the drawings in the below could be in simplified forms and not drawn in proportion to the real cases. Further, the dimensions of the drawings are enlarged for explaining and understanding more clearly.

Figure 1:
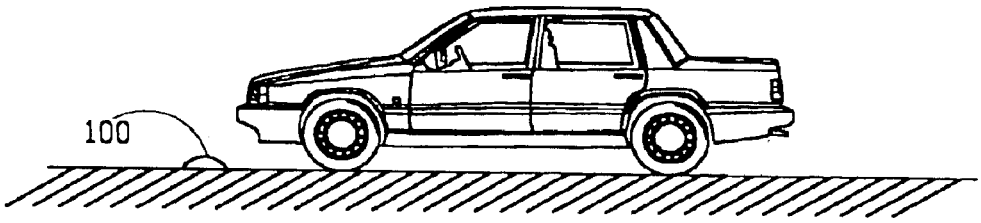
FIG.1(Prior Art)
FIG. 1 shows a traditional speed hump in a road for a motor vehicle.
Figure 2:
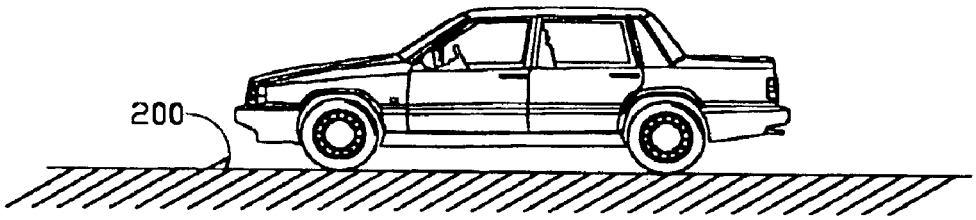
FIG.2(Prior Art)
FIG. 2 shows a traditional traffic hump in a road for a motor vehicle.
Figure 3A:
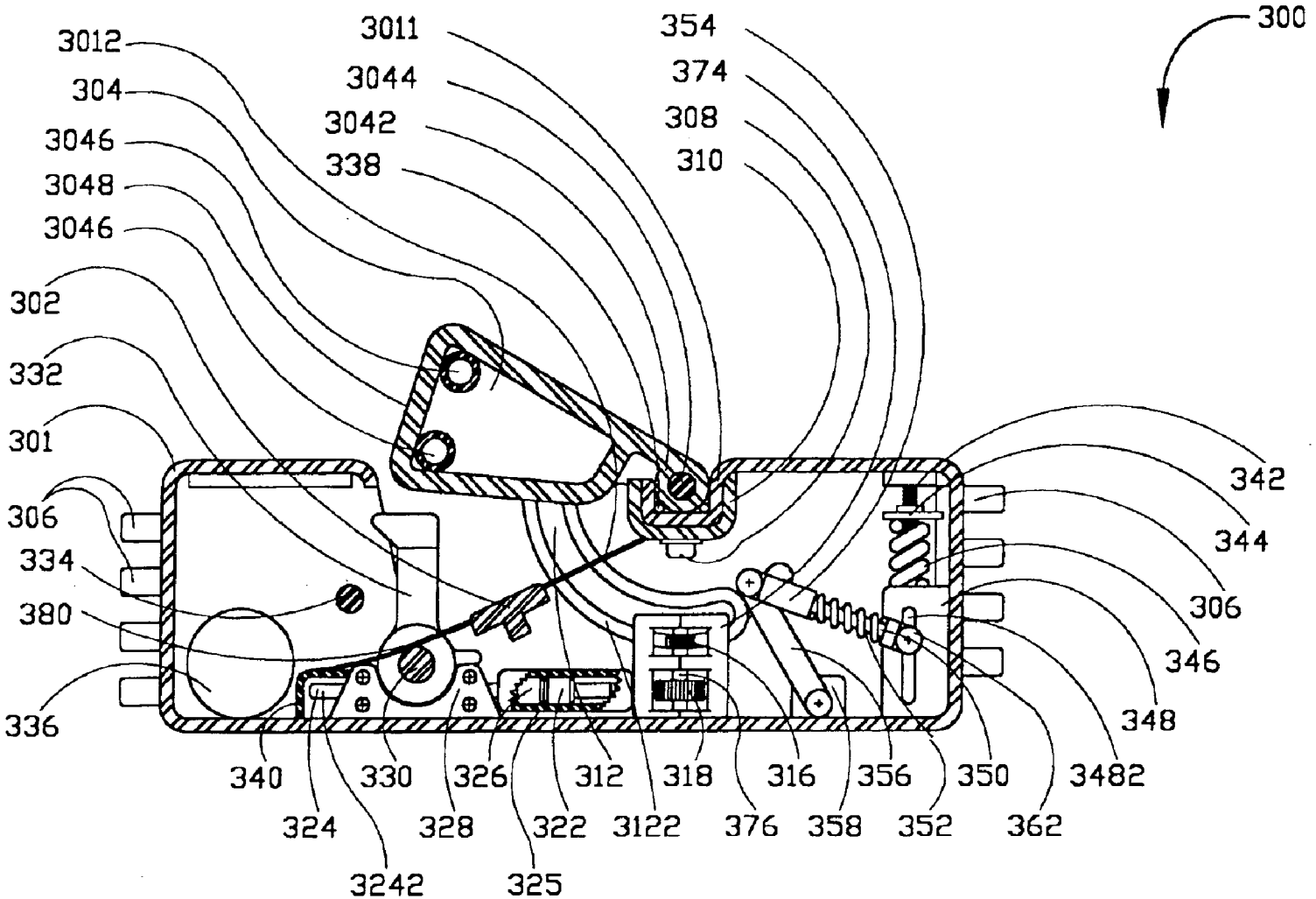
FIG. 3A shows a transverse cross-section view of a speed hump device in accordance with the present invention disclosed herein.
Figure 3B:
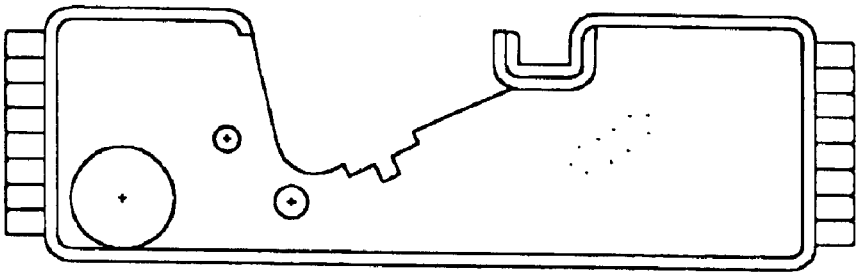
FIG. 3B shows the housing device of the present invention according to FIG. 3A.
Figure 3C:
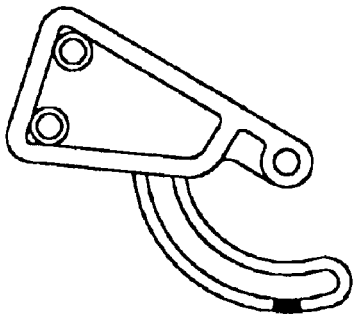
FIG. 3C shows the hump device of the present invention according to FIG. 3A.
Figure 3D:
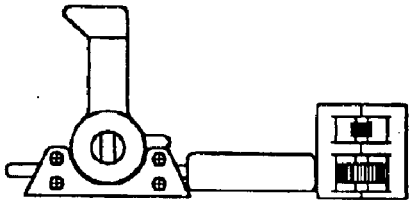
FIG. 3D shows the transmission device of the present invention according to FIG. 3A.
Figure 3E:
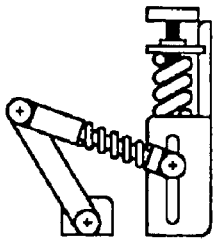
FIG. 3E shows the rebound device of the present invention according to FIG. 3A.
Figure 3F:
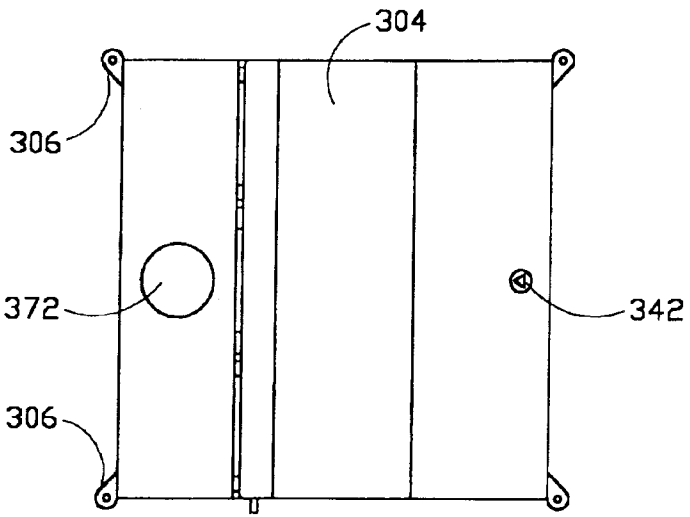
FIG. 3F shows a top view of the present speed hump device.
Figure 3G:
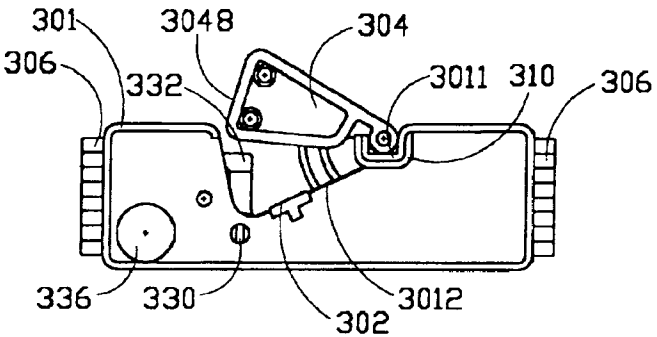
FIG. 3G shows a front view of the present speed hump device.
Figure 3H:
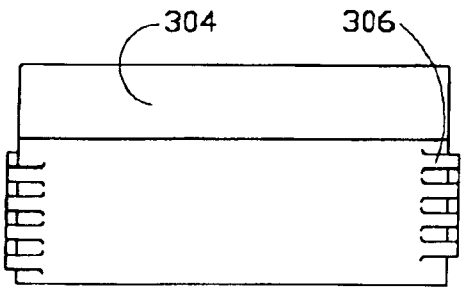
FIG. 3H shows a side view of the present speed hump device.

The present invention discloses a speed hump device for discouraging vehicles form exceeding a demanded threshold speed, one preferred embodiment of the present invention is shown as FIG. 3A. FIG. 3A is a transverse cross-section view of the preferred embodiment; FIG. 3F, FIG. 3G and FIG. 3H are respectively the top view, front view, and side view of the preferred embodiment. The preferred embodiment, a speed hump device 300 for motor vehicles, mainly includes four portions: a housing device as shown in FIG. 3B, a hump device as shown in FIG. 3C, a transmission device as shown in FIG. 3D and a rebound device as shown in FIG. 3E. And all the four portions will be described in detail below. Referring now to FIG. 3A, the figure of the housing device 301 is like a foursquare box with an empty housing room therein, and the housing device 301 has an opening and a slot 3011 on its top face. The slot 3011 in the embodiment is a U-type slot, as shown in FIG. 3A, but in other embodiment, other type slots also could be adopted. With the box figure, the housing device 301 can be conveniently mounted in a recess of a road, lane or turnpike, etc. Additionally, the housing device 301 also has a plurality of ear-type bolt sets 306 mounted on its four perpendicular sides, as shown in FIG. 3A, and two crevices in the same figure connected to the opening respectively located at a pair of opposed side faces, called front and rear faces, of the housing device 301 and in the symmetrical position. Each of the two crevices has a bevel edge 3012, as shown in FIG. 3A or in FIG. 3G, and a lump member 302 is deposited on the two bevel edges across the two crevices, wherein the lump member 302 could be a rigid bar in the embodiment.

Figure 3I:
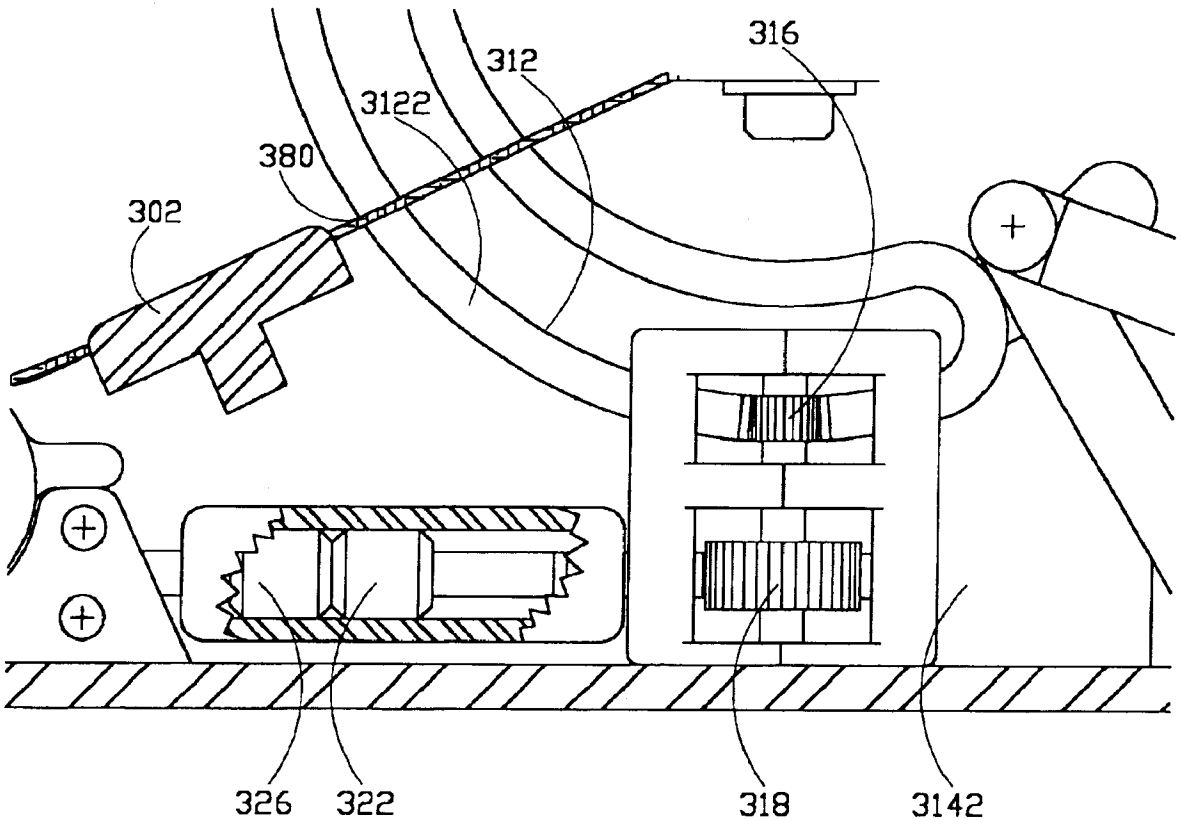
FIG. 3I shows a detail view of the gear part of the transmission device according to FIG. 3A.
Figure 3J:
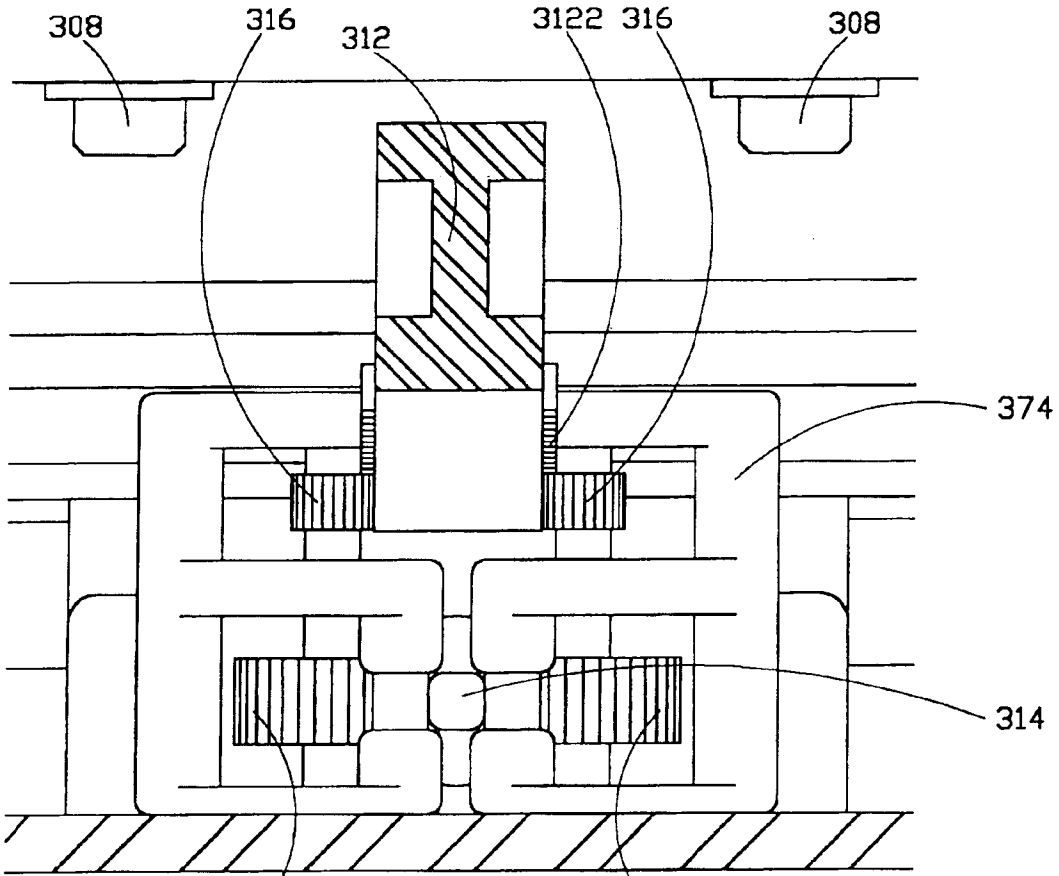
FIG. 3J shows a detail enlarged side view of the gear set of the present speed hump device.

Referring to FIG. 3A, in the embodiment, the hump device includes a hump member 304 which is a rigid body and its figure is substantially wedge-shaped with a steep side 3048. Each of a pair of opposed side of The hump member 304 has two insert holes 3046 thereon and their purposes will be interpreted later. The hump member 304 also has one extended portion 3042 with a first cylinder surface on its one side and the extended portion 3042 has a first penetrating cylinder hole therein, and the first penetrating cylinder hole is concentric with the cylinder surface of the extended portion 3042. The extended portion is placed in the inner room of the slot 3011. A first shaft 3044 is interposed in the first penetrating cylinder hole, and the first shaft 3044 is fixed on the slot 3011 via a plurality of screws 308 through the slot 3011 and the extended portion 3042. It should be noticed that, in the embodiment, the extended portion also has a plurality of penetrating portions (not shown), such as penetrating slots, on the cylinder surface, penetrated into and communicate with the first penetrating cylinder hole, so that, the plurality of screws 308 can tie up and fix the first shaft 3044 via through the slot 3011 and the plurality of penetrating portions of the extend portion 3042. In another word, the first shaft 3044 can be take as a "rotational pivot" and the hump member 304 is pivoted on the housing device 301 by the first shaft 3044. The hump member 304 can be rotated in and out the housing room of the housing device 301 from the opening about the first shaft 3044, and it looks like the screws 308 shuttle in the hollow space of penetrating portions of the extended portion 3042 during the rotating motion of the hump member 304. Additionally, when the hump member 304 rotates into the housing room to a certain degree, the hump member 304 will crash the lump member 302 and the rotating motion will be stop, at this time, the top surface of the hump member 304 is alignment with the road surface, as shown in FIG. 3N. Also, referring to FIG. 3A, a plurality of steel balls 338 are deposited between the slot 3011 and the first cylinder surface to promote the rotating motion of the hump member 304 more smooth. Beside, a U-type steel plate 310 is mounted and fixed below the slot 3011 by the plurality of screws 308 to enclose the outer bottom face of the slot 3011, as shown in FIG. 3A, to enhance the rigidity and loading force of the slot 3011. In other embodiment, rolling shafts or other rolling members could be substituted for the steel balls. An arc-shaped member 312, such as an arc-shape I-steel beam in the embodiment, is mounted on the hump member 304. The arc of the arc-shaped member 312 is concentric with the first shaft 3044, and has a gear-teeth portion 3122 thereon, the layout or arrangement of the gear-teeth portion 3122 is also concentric with the first shaft 3044.

Also referring to FIG. 3A, the transmission device in the embodiment includes a gear set assembled by a gear frame 374, or a gear box in other embodiments, mounted in the housing device 301. In the embodiment, the gear set includes at least two gear sets, a first gear set 316 and a second gear set 318, and there is a transmission ratio between the first gear set 316 and the second gear set 318, wherein the first gear set 316 is engaged with the gear-teeth portion 3122, as shown in FIG. 3A or in FIG. 3I. Besides, in the embodiment, as shown in FIG. 3J, both the first gear set 316 and the second gear set 318 respectively has two symmetric gears. Referring to FIG. 3I and FIG. 3J, when the first gear set 316 is rotated via the rotating motion of the arc-shaped member 312, the second gear set 318 will be also be driven to rotate by linkage shaft 376. The transmission device also includes a first rack 314, wherein the first rack 314 has a first gear-teeth portion 3142 thereon, as shown in FIG. 3I, and a first magnet 322 fixed at its one terminal. The first gear-teeth portion 3142 is engaged with the second gear set 318, so when the second gear set 318 is rotated by the first gear set 316, it will transmit (or pull) the first rack 314 together with the first magnet 322 move. The first magnet 322 is located in a sliding track of a sleeve 325 and can be slid backward and forward in the sleeve 325. Similarly, a second rack 324 has a second gear-teeth portion 3242 thereon and a second magnet 326 fixed at one terminal of the second rack 324. The second magnet 326 is also located in the sliding track of the sleeve 325 and can be slid backward and forward in the sleeve 325, wherein the second magnet 326 always faces to the first magnet 322 and the two magnets can attract each other. In other embodiment, the first rack 314 and the second rack 324 can be respectively substituted by two sliding shafts with gear-teeth portions thereon.

The transmission device in the embodiment also includes an abutment member 332, the abutment member 332 has a second cylinder surface at its one terminal and a second penetrating cylinder hole, wherein the second penetrating cylinder hole is concentric with the second cylinder surface. A hold pedestal 328 is mounted in the housing device 301 and has a concave-cylinder surface thereon. The abutment member 332 is located on the hold pedestal 328 and the second cylinder surface is engaged with the concave-cylinder surface. In the embodiment, a second shaft 330 with a third gear-teeth portion 3302 (shown in FIG. 3K) thereon is interposed and fixed in the second penetrating hole of the abutment member 332, in other word, there is no relation motion between the second shaft 330 and the abutment member 332, wherein the third gear-teeth portion 3302 is engaged with the second gear-teeth portion 3242 of the second rack 324. As the FIG. 3M shown, when the abutment member 332 is substantially in the position perpendicular to the hump member 304 and the first magnet 322 is separated from the second magnet 326, the abutment member 332 will prevent the hump member 304 from been rotating into the housing room of the housing device 301.

Figure 3K:
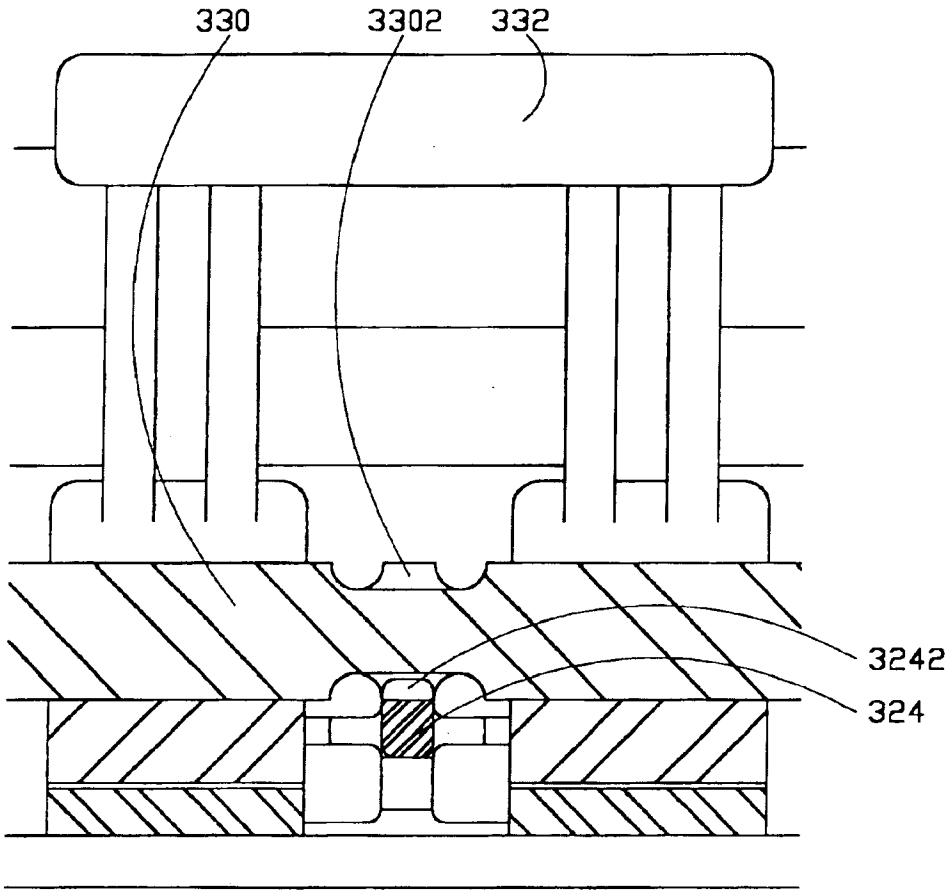
FIG. 3K shows a detail enlarged side view of the abutment member with the second rack of the present speed hump device.
Figure 3L:
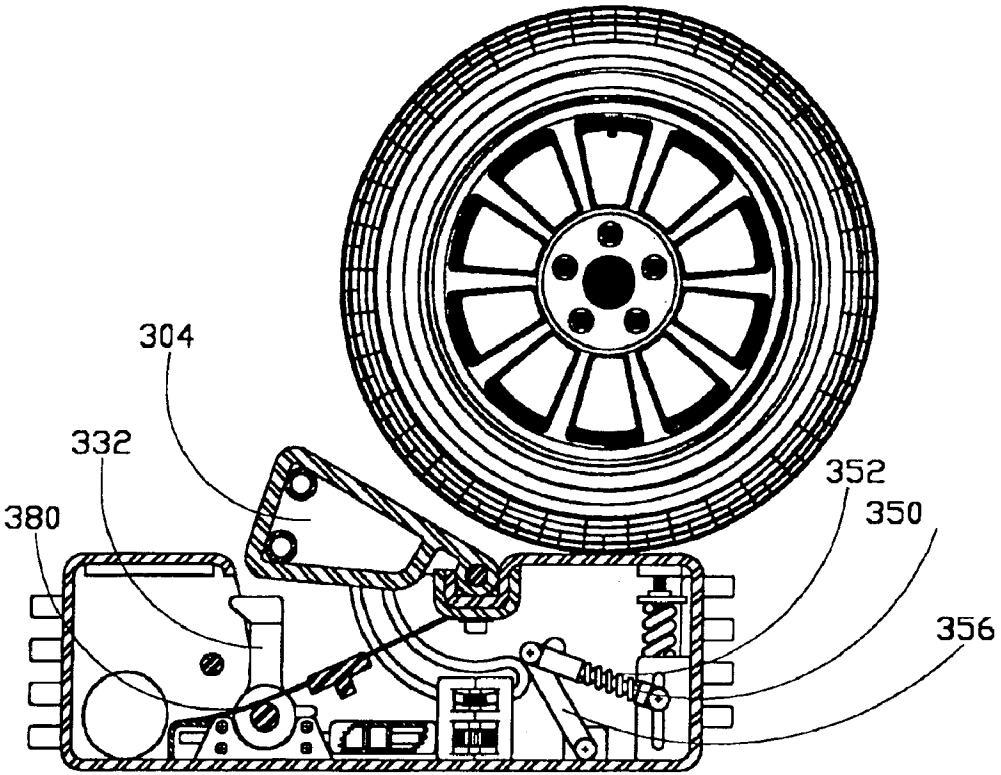
FIG. 3L shows the condition before the motor vehicle collides the hump member of the present speed hump device.
Figure 3M:
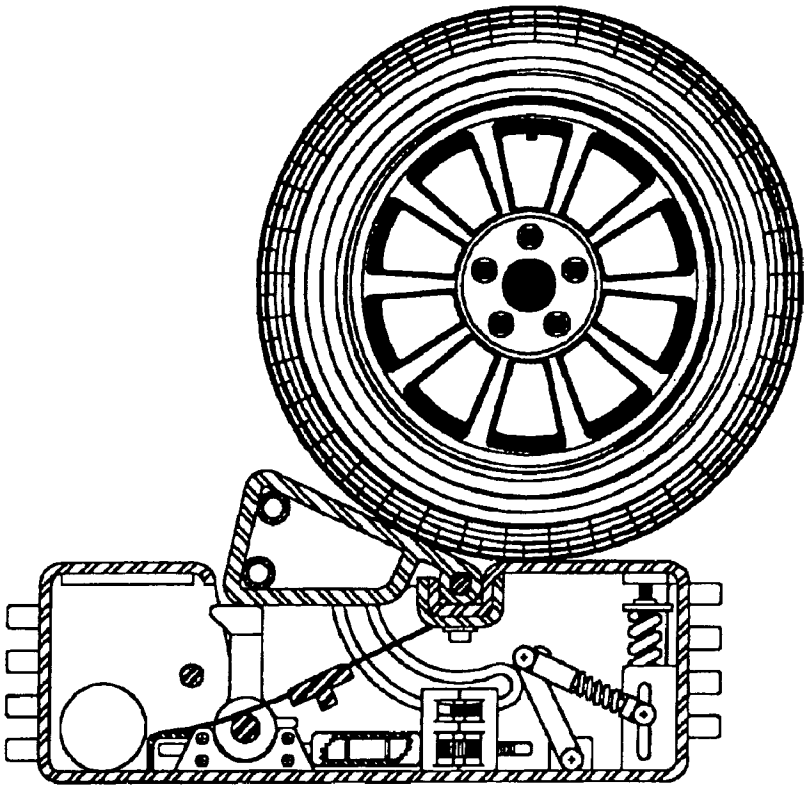
FIG. 3M shows the operation condition of the present speed hump device when the speed of the motor vehicle is over the demanded threshold speed.
Figure 3N:
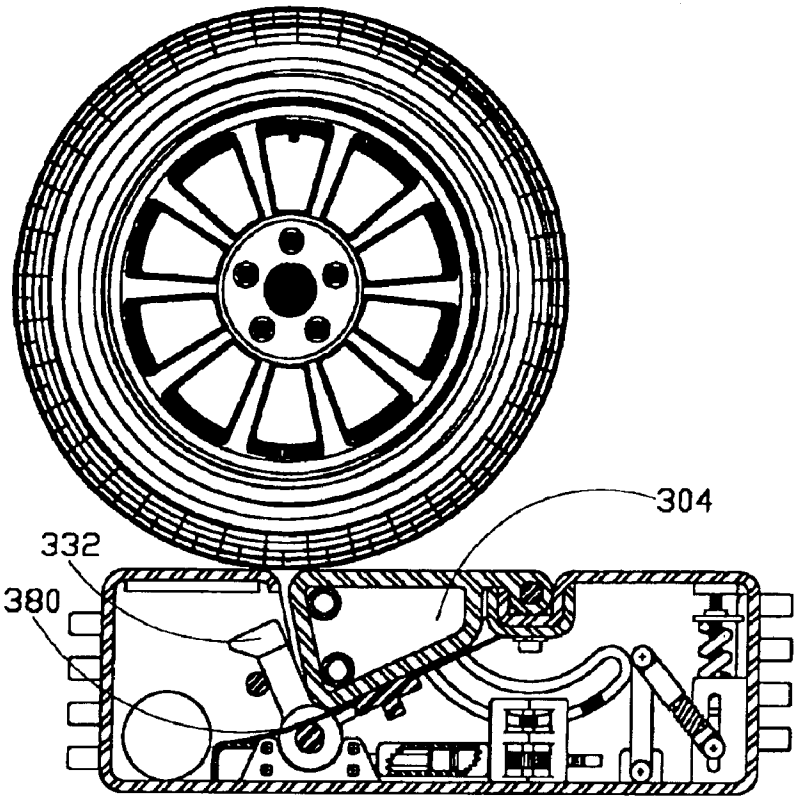
FIG. 3N shows the operation condition of the present speed hump device when the speed of the motor vehicle is below the demanded threshold speed.
Figure 3O:
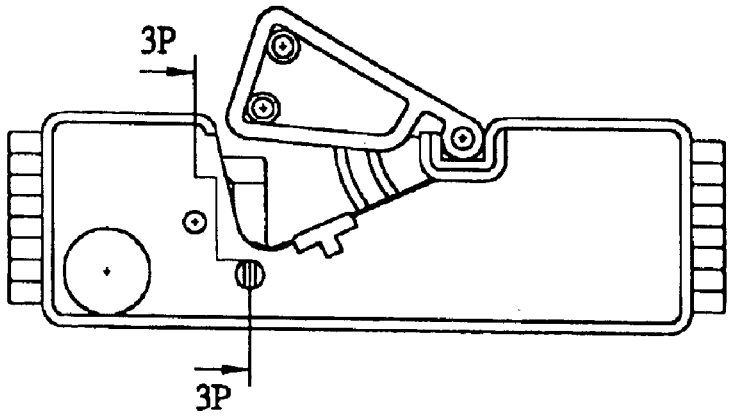
FIG. 3O and FIG. 3P show the position of the cross-section 3P—3P and the view of the cross-section 3P—3P of the present speed hump device.

It should be noticed again that, in the embodiment, the abutment member 332 is designed to have a hollow space, as shown in FIG. 3K, to expose the third gear-teeth portion 3302 of the second shaft 330 to engage the second gear-teeth portion 3242. Of course, in other embodiment, the abutment member 332 could be designed to have a penetrating portion, such as a penetrating slot, on the second cylinder surface, penetrates into and communicates with the second penetrating hole, and thereby the third gear-teeth portion 3302 is exposed via the penetrating portion. It could be known obviously, when the first rack 314 is moving and the first and second magnet attracts each other, the second gear-teeth portion 3242 will be moved together with the second rack 324 and at the same time the third gear-teeth portion 3302 will be transmitted by the second gear-teeth portion 3242 to make the abutment member 332 have a rotating motion about the second shaft 330. A support member 334 is mounted in the housing device 301 used to prevent the abutment member 332 from rotating when the abutment member 332 rotates counterclockwise to a certain degree, as shown in FIG. 3N. From above, a brief speaking is the transmission device of the present speed hump device can be mainly divided into two portion, a first transmission device and a second transmission device, wherein the first transmission device includes the first gear set 316, the linkage shaft 376 the second gear set 318, the first rack 314 and the first magnet 322; and the second transmission device includes the second rack 324, the second magnet 326, the second shaft 330, the hold pedestal 328 and the abutment member 322, further, the second transmission device is driven by the first transmission device through the attracting condition between the first magnet 322 and second magnet 326.

Referring to FIG. 3A again, in the embodiment, the rebound device includes a screw shaft 342 whose one terminal is mounted in the housing device 301 and a screw nut 344 assembled on the screw shaft 342. A first spring 346 is slipped on the screw shaft 342, one terminal of the first spring 346 is fixed on the screw nut 344 and the another terminal is fixed on one terminal of a sliding pivot 362. The another terminal of the sliding pivot 362 is pivoted with a first lever 350. The sliding pivot 362 is pivoted through a sliding slot 3482 of a steel plate 348 mounted in the housing device 301 and can be slid backward and forward in the sliding slot 3482. A second spring 352 and a sleeve 354 is slipped on the first lever 350, wherein one terminal of the second spring 352 is fixed on the first lever 350 and the another terminal is fixed on one terminal of the sleeve 354, and the another terminal of the sleeve 354 is pivoted with one terminal of a second lever 356. The another terminal of the second lever 356 is pivoted with a pedestal 358 mounted in the housing device 301, wherein the second lever 356 always keeps contacting with the arc-shaped member 312 to push the hump member 304 out the housing room of the housing device 301, and at the same time, to push the abutment member 332 from the position laying on the support member 334 to be in the position perpendicularly to the hump member 304, when no extra force from outside of the housing room presses on the hump member 304. It needs to be specially notice, in the embodiment, the first spring 346 is a expansion spring and the second spring 352 is a compression spring.

Additionally, the speed hump device 300 in the embodiment further includes a hamper (retaining) plate 340 mounted in the housing device 301, the hamper plate 340 with other four inner faces of the housing device 301 forms a receiver (capacity) room. The speed hump device 300 also includes a waterproof cover 380, as shown in FIG. 3A or in FIG. 3I, mounted in the housing device 301 and attached on the lump member 302. One side of a waterproof cover 380 is fixed on the outer bottom surface of the steel plate 310 and the another opposite side of the waterproof cover 380 is fixed on the hamper plate 340, further the another pair sides of the waterproof cover 380 are respectively attached to the two bevel edges 3012, wherein the arc-shaped member 312 and the abutment member 332 penetrate through the waterproof cover 380. In the embodiment, the waterproof cover 380 is made of a waterproof canvas, but in other embodiments, it would be made of other elastic waterproof materials. The waterproof cover 380 covers the great part inner devices or members in the housing device 301, such as the hold pedestals 328, the sleeve 325, the gear frame 374 and so on, and is used to let the dirty water or filth coming from the opening of the housing device 301 slide into the receiver room easily to protect the inner devices in the housing device 301 from being fouled and damaged. Additionally, the hamper plate 340 is also used to resist the dirty water or filth in the receiver room flowing out of therein. Each of the front and rear faces of the housing device 301 also has a circle opening 336 thereon penetrates into and communicates the receiver room. The two circle openings 336 can be associated with draining pipes to drain the dirty water from the receiver room. Further, the top face of the housing device 301 also has a circle opening 372 thereon, as shown in FIG. 3F, and also a lid covers on the circle opening 372 to resist outer things coming into the housing device 301 from the circle opening 372. By the circle opening 372, people can clear up the dirty water or filth deposited in the receiver room or the housing room of the housing device 301.

Figure 3P:
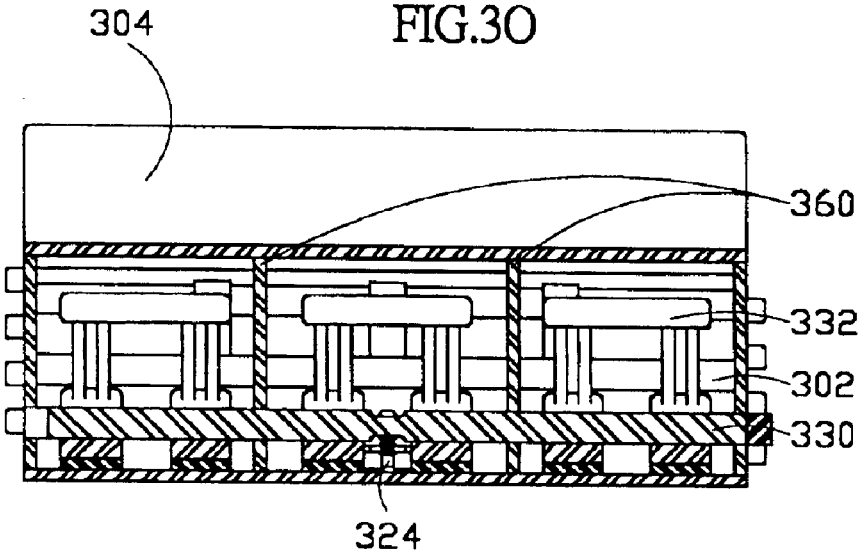
Figure 3Q:
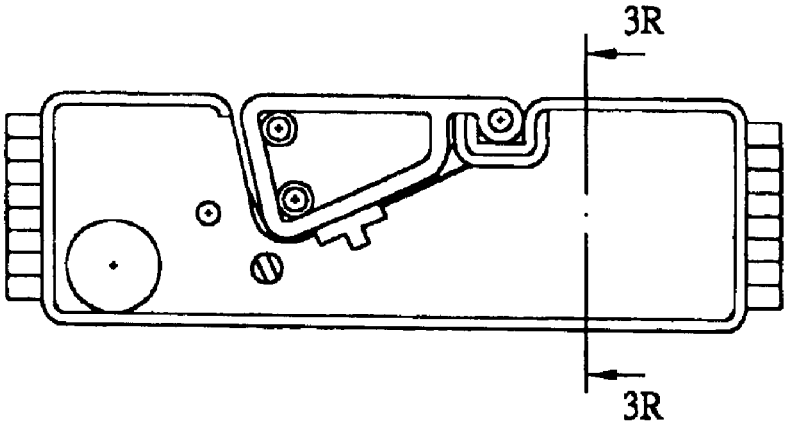
FIG. 3Q and FIG. 3R show the position of the cross-section 3R—3R and the view of the cross-section 3R—3R of the present speed hump device.
Figure 3R:
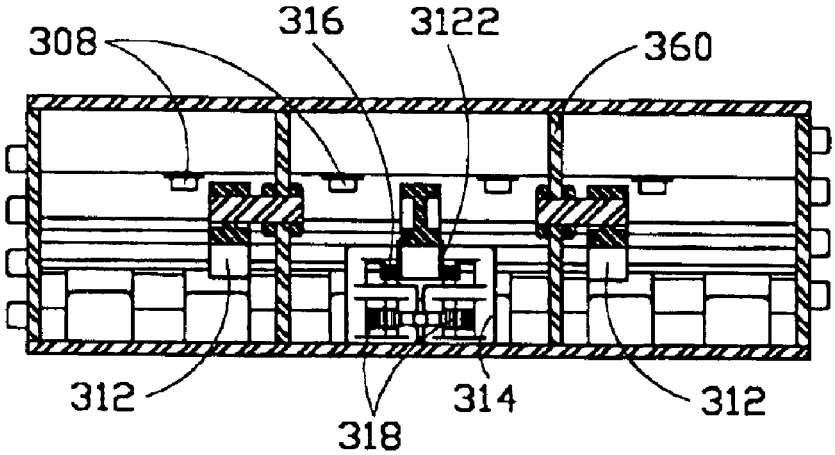
Figure 3S:
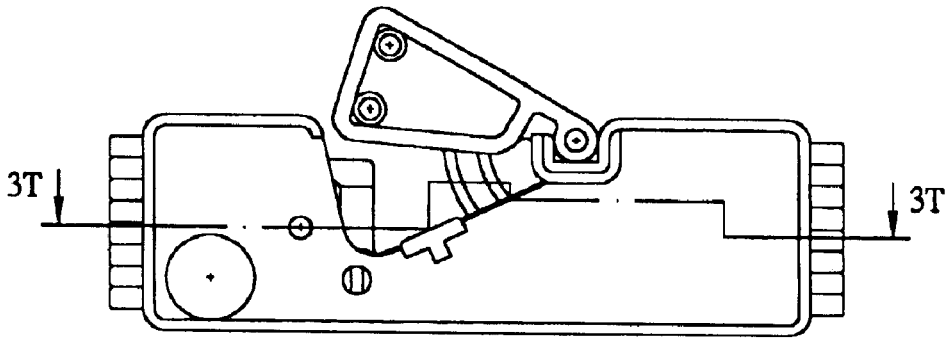
FIG. 3S and FIG. 3T show the position of the cross-section 3T—3T and the view of the cross-section 3T—3T of the present speed hump device.
Figure 3T:
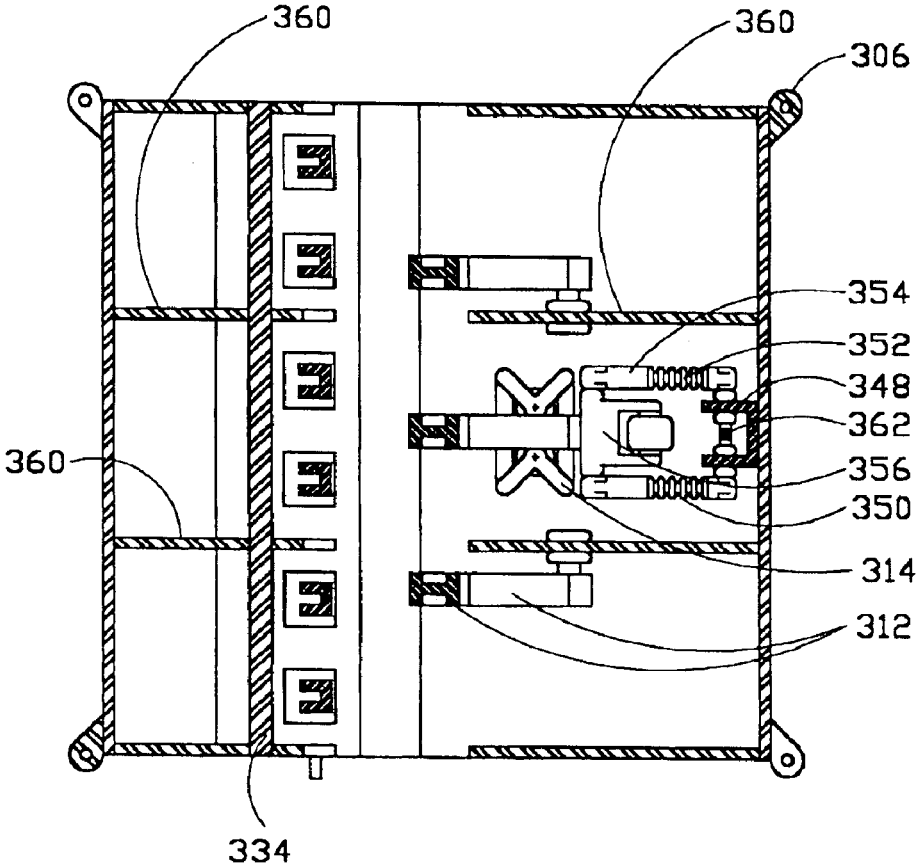
Figure 3U:
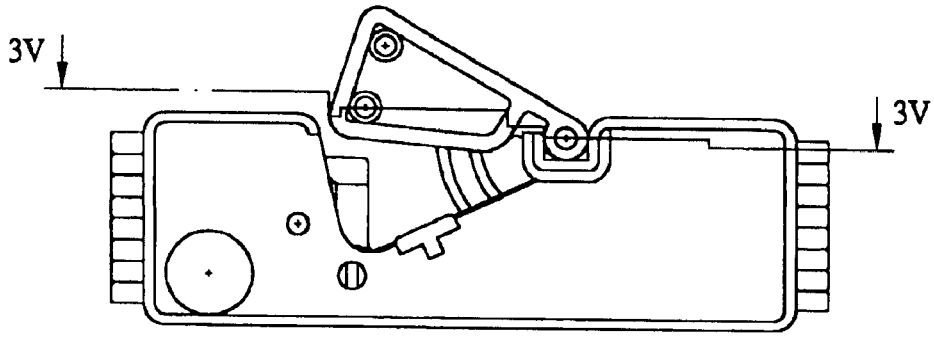
FIG. 3U and FIG. 3V show the position of the cross-section 3V—3V and the view of the cross-section 3V—3V of the present speed hump device.
Figure 3V:
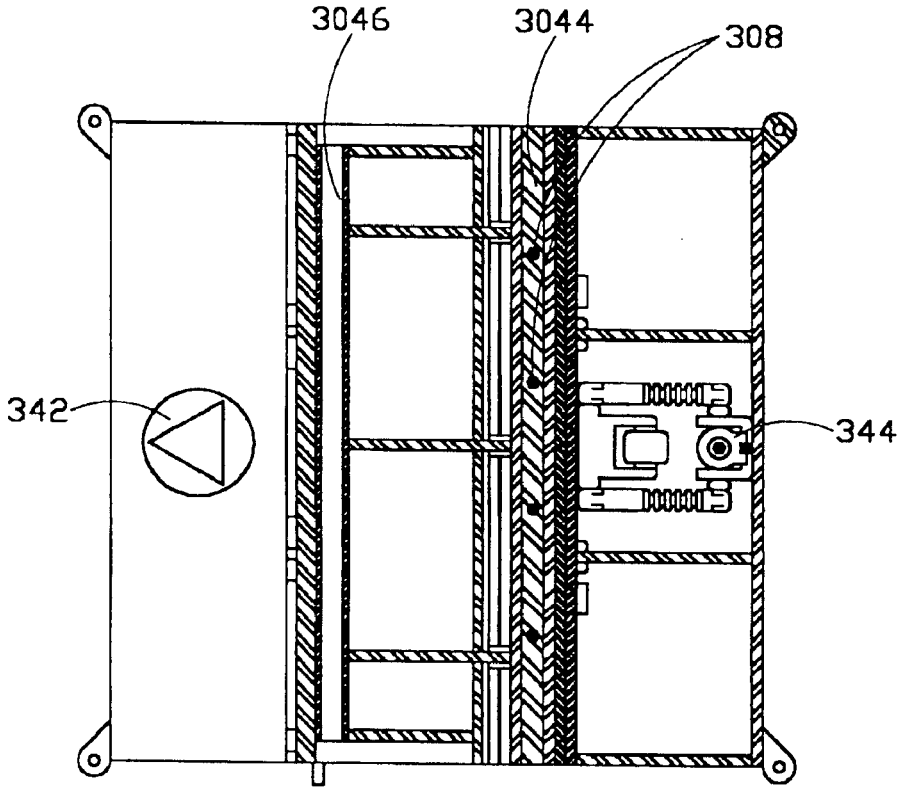
Figure 3W:
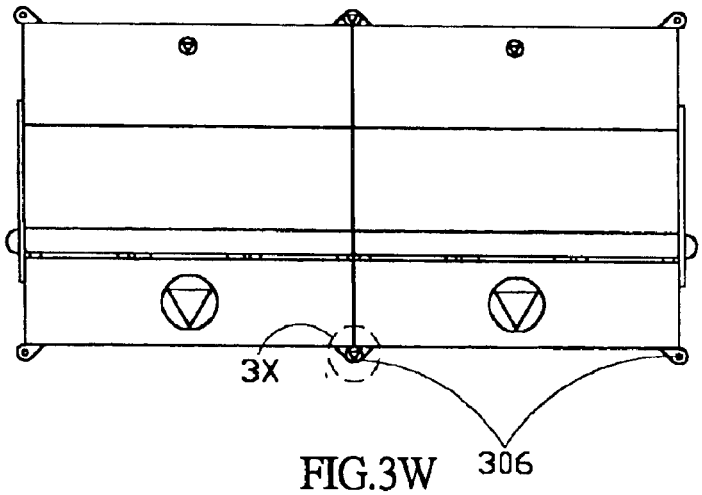
FIG. 3W shows the top view of the combined condition of two the present speed devices.
Figure 3X:
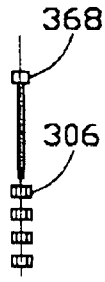
FIG. 3X shows the combined condition presented in FIG. 3W is accomplished via the bolt through the holes of the plurality of ear-type bolt sets.
Figure 3Y:
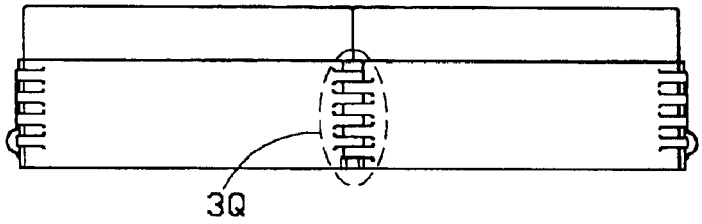
FIG. 3Y shows the front view of the combined condition of two the present speed hump devices.
Figure 3Z:
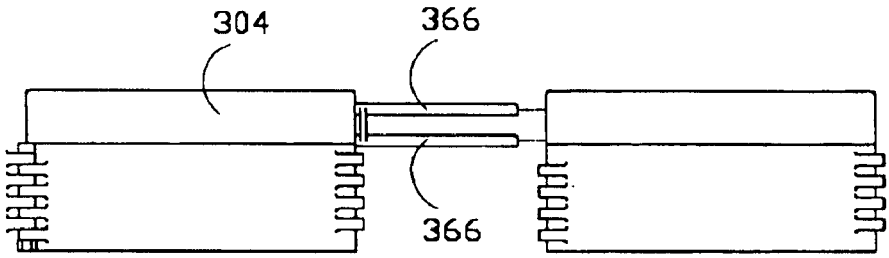
FIG. 3Z shows the combined condition of two the hump members presented in FIG. 3Y is accomplished via a link shaft through the insert holes.

It should be specially noticed the above-mentioned contents only describe the main structures of the embodiment and the number of some of the devices or members in the embodiment is not limited to only one, in the condition without departing from the feature and function of the present invention, people can increase the number of some of the devices for symmetry or for other purposes, when design, if needed. For example, FIG. 3P shows the view of the cross-section 3P—3P of FIG. 30 according to the embodiment. In FIG. 3P, we can see there are three abutment members 332 and three hold pedestals 328 in the housing device 301, and the three abutments 332 are interposed and fixed with each other by the second shaft 330, namely, there is no relative motion between the three abutments 332 and the second shaft 330, or namely, the there abutments 332 and the second shaft 330 can be moved together. Besides, in FIG. 3P, two steel plates 360 as support plates are mounted in the housing device 301 between the top and bottom inner surface of the housing device 301 to prop up the top face of the housing device 301 to strengthen its supporting force. In other embodiments, more steel plates 360 could be set in the housing device 301 to strengthen the supporting force of the top face, if needed. Similarly, FIG. 3R, FIG. 3T and FIG. 3V are respectively views of the cross-section 3R—3R of FIG. 3R, the cross-section 3T—3T of FIG. 3T and the cross-section 3V—3V of FIG. V according to the embodiment. Form these figures with reference to the indicator numbers of the devices, it can be best understood the amount and figure of the corresponding devices as well as the relative position between them. As the previous mentions, the present speed hump device 300 can be mounted in a recess of a road, lane or turnpike, etc. As the width of a road concerned, a plurality of the speed hump devices 300 can be linked and combined with one another, as shown in FIG. 3W, via their ear-type bolt sets 306. FIG. 3X shows the combined condition of the plurality of the speed hump devices 300 is accomplished via the bolt 368 through the holes of the plurality of ear-type bolt sets 306. FIG. 3Y shows the front view of the combined condition according to FIG. 3W and FIG. 3Z shows each of the hump members 304 of the plurality of the speed hump devices 300, in the combined condition, can be fixed and coupled with one another via a plurality of the link shafts 366 through the insert holes 3046 of the hump members 304, as shown in FIG. 3Z, and that make the hump members 304 move together, namely, there is no relative motion between them when they move. Additionally, in the embodiment, the second shaft 330 has a projection portion at one terminal of the second shaft 330 and a concave portion at the another terminal, by the structure, in the combined condition shown as FIG. 3W, the projection portion of the second shaft 330 of one speed hump device 300 can be assembled into the concave portion of the second shaft 330 of other speed hump device 300, thus the second shafts 330 of the plurality of the speed hump device 300 can be also fixed and couple with one anther to make no relative motion between them when they move. It is necessary to notice all the figures of the present members described above could not include the complete views, only the important ones are shown. The present speed hump device 300 can be implemented by any kind of manufacturing technologies, all the members of the present speed hump device 300 are rigid bodies and can be made of any suitable materials, such as steel, alloy, etc.

The operation manner or method of the present speed hump device 300 is described below. As shown in FIG. 3M, when the wheel of the passing car initially impacts and depresses the hump member 304, the hump member 304 will start to be rotated or depressed into the housing room from the opening of the housing device 301, at the same time, the are-shaped member 312 transmits the first gear 316 by the gear-teeth portion 3122 and the first gear set 316 drives the second gear 318. Following, the second gear 318 transmits the first rack 314 together with the first magnet 322 by the first gear-teeth portion 3142 engaged with the second gear 318. At this time, if the speed of the passing car is too fast, such as over a demanded threshold speed pre-set in the speed hump device 300, then the wheel of the car occurs a large momentum force to the hump member 304. Following, the hump member 304 will fast transmit the gears of the gear set that makes the first magnet 322 move toward right too fast to occur a transient momentum force to separate the first magnet 322 from the second magnet 326. Thereby, the first rack 314 can not drive the second rack 324 to move toward right to transmit the abutment member 332 rotate counterclockwise by the third gear-teeth portion 3302 engaged with the second gear-teeth portion 3244, and the abutment member 332 will still stand perpendicularly to let the hump member 304 lay thereon and prevent the hump member 304 from been rotating in the housing room. Therefore, the hump member 304 will be still in the position out the road surface that an impact effect occurs and makes the car got a bumpy road. If the speed of the passing car is slow, such as under the demanded threshold speed, a large transient momentum force will not occur and the first magnet 322 still keeps attracting the second magnet 326. Therefore, the second magnet 326 will move with the second rack 324 to transmit the abutment member 332 rotating counterclockwise to let the hump member 304 rotate into the housing room smoothly. Subsequently, the hump member 304 can be moved into alignment with the road surface, as shown in FIG. 3N, and the uncomfortable impact effect will disappear, hence the car will traverse the speed hump device 300 smoothly.

Figure 4:
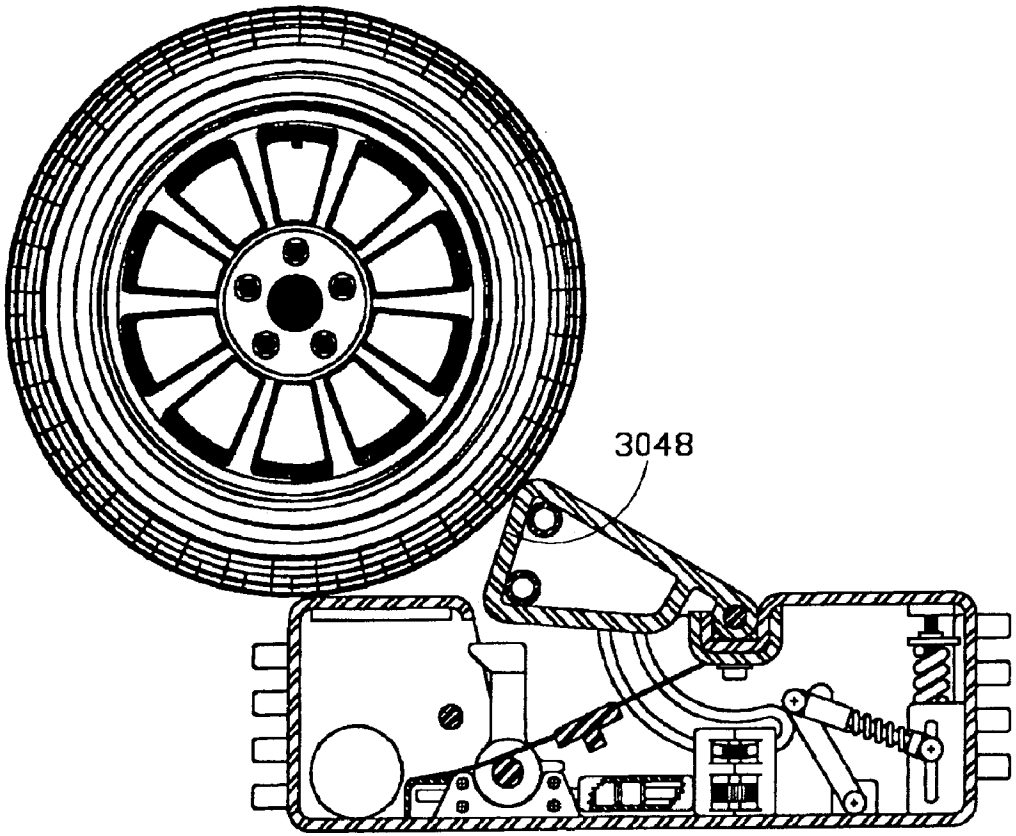
FIG. 4 shows the condition when the going direction of the motor vehicle is against the traffic flow direction according to the present invention.

After the car passing through the hump member 304 smoothly, the second lever 356 of the rebound device will push the hump member 304 out of the housing room via pushing the arc-shaped member 312 to rotate clockwise, so the position of the hump member 304 returns to be upper the road surface again, at the same time, the motion of the second lever 356 will also drive the abutment member 332 to be in the position perpendicularly to the hump member 304 again through the transmission device. Additionally, the impact effect of the present speed hump device 300 also can be canceled or vanished forever by just revolving the screw shaft 342 form the top face of the housing device 301, shown in FIG. 3F, to move the screw nut 344 and the first spring 346 down to cancel the rebound effect of the rebound. Also, the rebound effect of the rebound device could be enhanced by just revolving the screw shaft 342 to move the screw nut 344 and the first spring 346 up. Further, if the going direction of the car is against the traffic flow direction, such as running from lift to right in FIG. 4, the car will crash the bevel side 3048 of the hump member 304, thereby, the hump member 304 will cause an impedimental effect to motor vehicles whose going direction against the traffic flow direction. As the above-mentioned descriptions, the demanded threshold speed of the speed hump device 300 is related to the attractive force between the first magnet 322 and the second magnet 326. If the attractive force between them is increased, it will be more hard to separate the first magnet 322 from the second magnet 326 that the speed hump device 300 will endure a higher speed of a car traverses thereon to make the first magnet 322 keep attracting the second magnet 326 continuously, so the demanded threshold speed of the speed hump device 300 will be larger; on the contrary, if the attractive force between the two magnets is decreased, then a lower demanded threshold speed is got. Hence, the demanded threshold speed of the speed hump device 300 can be pre-set by making a replacement of the two magnets to change the attractive force. It could be known from above that the energy which drives the present speed hump device 300 is coming from the motor vehicle passing thereon and the rebound device, thus another advantage of the present speed hump device 300 is its operation does not rely on a manual operation or an electrical device, in other words, it consumes no extra labor power or electrical power.

The above-mentioned preferred embodiments of the present invention are just for example, not limits. Thus, many variations and modifications of the embodiments made without departing form the spirit of the present invention should be covered by the following claims.

What is claimed is:

1. A speed hump device, comprising:

a housing device with a housing room therein having a first opening;

a hump device with a hump member and an arc-shaped member pivoted on said housing device by a first pivot, wherein said hump member can be rotated in and out said housing room from said first opening about said first pivot, and the arc of said arc-shaped member is concentric with said first pivot, and said arc-shaped member has a first gear-teeth portion thereon;

a gear set mounted in said housing device at least comprising a first gear and a second gear, wherein said first gear is engaged with said first gear-teeth portion, and when said hump device is rotated about said pivot, said first gear can be driven to rotate by said arc-shaped member to drive said second gear to rotate;

a first sliding shaft having a second gear-teeth portion thereon and a first magnet mounted on one terminal of said first sliding shaft, wherein said second gear-teeth portion is engaged with said second gear;

a second sliding shaft having a third gear-teeth portion thereon and a second magnet mounted on one terminal of said second sliding shaft, wherein said second magnet faces to and can attract said first magnet;

an abutment member having a fourth gear-teeth portion pivoted in said housing device by a second pivot, wherein said fourth gear-teeth portion is engaged with said third gear-teeth portion, and when said second sliding shaft moves, it will drive said abutment member to rotate about said second pivot, wherein said abutment member is used to prevent said hump member from completely been depressing in said housing room when said first magnet is separated form said second magnet; and a rebound device mounted in said housing device used to push said hump device to let said hump member be out said housing room and to push said abutment member to be in the position to prevent said hump member from moving into said housing room, when no force from the outside of said housing room presses on said hump member.

2. The speed hump device according to claim 1, wherein said first sliding shaft and said second sliding shaft are respectively racks.

3. The speed hump device according to claim 1, wherein said hump member is substantially a wedge-shaped rigid body.

4. The speed hump device according to claim 1, further comprises a support member mounted in said housing device used to stop the continuous moving of said abutment member when said abutment rotates to a certain degree.

5. The speed hump device according to claim 1, further comprises a lump member mounted in said housing device used to let said hump member lay thereon when said hump member are completely in said housing room.

6. The speed hump device according to claim 1, wherein said housing device has a second opening used to clean up said housing room.

7. The speed hump device according to claim 1, wherein said housing device has a plurality of bolt sets mounted on said housing device used to combine other said speed hump device.

8. The speed hump device according to claim 1, wherein said hump member has at least two insert holes respectively located at a pair of two opposite side faces of said hump member used to combine said hump member with the hump member of other said speed hump device via a link shaft through said insert holes to let no relative motion between said two hump members.

9. The speed hump device according to claim 1, further comprises a waterproof cover mounted in said housing device used to protect the devices or members in said housing device from being fouled or damaged by external things coming from the outside of said housing room and let said external things slide into said housing room smoothly.

10. The speed hump device according to claim 1, wherein said housing device has at least a second opening located at said housing device used to drain the fluid in said housing room out.

11. A speed hump member device, comprise:

a housing device whose figure is foursquare box with a housing room therein having, a first opening and a slot on its top face, a first and second crevices respectively on a pair of two opposite side faces of said housing device, wherein each of said first and second crevices has a bevel edge;

a hump member having a extended portion with a first cylinder surface, wherein said extended portion has a first penetrating cylinder hole concentric with said first cylinder surface and a plurality of penetrating slots penetrate and communicate said first penetrating cylinder hole, and said extended portion is placed on said slot;

a first shaft interposed said first penetrating cylinder hole, wherein said first shaft is fixed on said slot via a plurality of screws through said slot and said plurality of penetrating slots;

an arc-shaped member with a first gear-teeth portion thereon mounted on said hump member, wherein the arc of said arc-shaped member and the arrangement of said first gear-teeth portion are concentric with said first shaft;

a lump member mounted on said bevel edges of said two crevices used to let said hump member lay thereon when said hump member is rotated about said first shaft to be in said housing room;

a gear set mounted in said housing device at least comprising a first gear and a second gear, wherein said first gear is engaged with said first gear-teeth portion;

a first sliding shaft having a second gear-teeth portion thereon and a first magnet mounted on one terminal of said first sliding shaft, wherein said first gear-teeth portion is engaged with said second gear and said first magnet is located in a sliding track mounted in said housing device;

a second sliding shaft having a third gear-teeth portion thereon and a second magnet mounted on one terminal of said second sliding shaft, wherein said second magnet faces to and can attract said first magnet, and said second magnet is located in said sliding track;

a hold pedestal member with a concave-cylinder surface mounted in said housing device;

an abutment member placed on said concave-cylinder surface having a second cylinder surface and a second penetrating cylinder hole concentric with said second cylinder surface;

a second shaft with a fourth gear-teeth portion interposed in and fixed with said second penetrating cylinder hole, wherein said fourth gear-teeth portion is engaged with said third gear-teeth portion;

a support member mounted in said housing device used to stop a continuous moving of said abutment member when said abutment member be rotated to a certain degree; and a rebound device mounted in said housing device, wherein said rebound device has a rebound effect to push said hump device to let said hump member be out said housing room and to push said abutment member to be in the position to prevent said hump member from moving into said housing room, when no force from the outside of said housing room presses on said hump member.

12. The speed hump device according to claim 11, wherein said hump member is substantially a wedge-shaped rigid body with a steep side to make a motor vehicle with a going direction against the traffic flow direction get a impedimental effect.

13. The speed hump device according to claim 11, further comprises a plurality of support plates mounted in said housing device to strengthen the supporting force of the top face of said housing device.

14. The speed hump device according to claim 11, wherein said rebound device comprises a screw shaft whose one terminal is mounted in said housing device;

a screw nut assembled into and placed on said screw shaft;

a first spring slipped on said screw shaft, wherein one terminal of said first spring is fixed on said screw nut;

a sliding pivot pivoted through a sliding slot of a steel plate mounted in said housing device, wherein one terminal of said sliding pivot is fixed on the another terminal of said first spring and the another terminal of said sliding pivot is pivoted with a first lever;

a second spring and a sliding sleeve slipped on said first lever, wherein one terminal of said second spring is fixed on said first lever and the another terminal of said second spring is fixed on one terminal of said sliding sleeve, and the another terminal of said sliding sleeve is pivoted with one terminal of a second lever, and the another terminal of said second lever is pivoted in said housing device, wherein said second lever always keeps contacting with said arc-shaped member, and said screw shaft could be used to cannel, increase or decrease said rebound effect by moving said screw nut down or up.

15. The speed hump device according to claim 11, wherein said hump member has at least two insert holes respectively located at a pair of two opposite side faces of said hump member used to combine said hump member with the hump member of other said speed hump device via a link shaft through said insert holes to let no relative motion between said two hump members.

16. The speed hump device according to claim 11, wherein said second shaft has a projection portion at one terminal of said second shaft and a concave portion at the another terminal, and said projection portion can be used to combine with the concave portion of other said speed hump device to let no relative motion between said two second shafts.

17. A method for discourage a motor vehicle from exceeding a demand threshold speed, comprising:

providing a housing device with a housing room therein and a opening thereon, wherein said housing device is mounted in a recess of a road;

mounting a hump device with a hump member on said housing device, wherein said hump device is pivoted on said housing device by a first pivot and said hump member can be rotated in and out said hosing room from said first opening about said fist pivot;

mounting a transmission device in said housing device, said transmission device comprises a first transmission portion with a first magnet, a second transmission portion with a second magnet and a abutment member, wherein said first magnet faces to and can attract said second magnet, and said first transmission is engaged with said hump device, and said second transmission portion is engaged with said abutment member;

mounting a rebound device in said housing device, wherein said rebound device has a rebound effect to push said hump device to let said hump member be out said housing room and to push said abutment member to be in the position to prevent said hump member from moving into said housing room, when no force form the outside of said housing room presses on said hump member.

making said hump member be out said housing room and said motor vehicle get a impact effect, when the speed of said motor vehicle passing through said speed hump is above said demanded threshold speed pre-set via said transmission device; and making said hump member be in said housing room and alignment with said road surface, when the speed of said motor vehicle passing through said speed hump is below said demanded threshold speed.

18. The method according to claim 17, wherein said making said hump member be out said housing room is accomplished through separating said first magnet from said second magnet by the wheels of said motor vehicle depressing on said hump member and let said abutment member be in said position; and said making said hump member be in said housing room is accomplished through keeping said first magnet attracting said second magnet to pull down said abutment member to let said hump member into said housing room by the wheels of said motor vehicle.

19. The method according to claim 17, further comprises increasing the attracting force between said first magnet and said second magnet, if want to make the value of said demanded threshold speed become higher; and decreasing said attracting force, if want to make the value of said demanded threshold speed become lower.

20. The method according to claim 17, further comprises adjusting some of the inner members or devices of said rebound device, if want to cancel said rebound effect to make said impact effect vanish forever; and adjusting some of the inner members or devices of said rebound device, if want to increase or decrease said rebound effect.

* * * * *